US011155386B2

(12) United States Patent
Kokubo

(10) Patent No.: US 11,155,386 B2
(45) Date of Patent: Oct. 26, 2021

(54) CONTAINER

(71) Applicant: ROHTO PHARMACEUTICAL CO., LTD., Osaka (JP)

(72) Inventor: Shigehiko Kokubo, Osaka (JP)

(73) Assignee: ROHTO PHARMACEUTICAL CO., LTD.

( * ) Notice: Subject to any disclaimer, the term of this patent is extended or adjusted under 35 U.S.C. 154(b) by 444 days.

(21) Appl. No.: 16/094,013

(22) PCT Filed: Apr. 25, 2016

(86) PCT No.: PCT/JP2016/062950

§ 371 (c)(1),
(2) Date: Oct. 16, 2018

(87) PCT Pub. No.: WO2017/183213

PCT Pub. Date: Oct. 26, 2017

(65) Prior Publication Data

US 2019/0127119 A1 May 2, 2019

(30) Foreign Application Priority Data

Apr. 22, 2016 (JP) ..... JP2016-086247

(51) Int. Cl.

| | |
|---|---|
| ***B65D 41/04*** | (2006.01) |
| ***B65D 47/12*** | (2006.01) |
| ***B65D 50/04*** | (2006.01) |
| ***B65D 41/17*** | (2006.01) |
| ***B65D 47/18*** | (2006.01) |

(52) U.S. Cl.

CPC ..... *B65D 41/04* (2013.01); *B65D 41/17* (2013.01); *B65D 47/12* (2013.01); *B65D 47/18* (2013.01);

(Continued)

(58) Field of Classification Search

CPC ..... B65D 41/0478; B65D 41/0428; B65D 41/06; B65D 41/16; B65D 41/17;

(Continued)

(56) References Cited

U.S. PATENT DOCUMENTS 2,990,075 A 5/1955 Rhodes
2,847,139 A * 8/1958 Christiansson ..... B65D 50/041 215/220

(Continued)

FOREIGN PATENT DOCUMENTS

GB 1 414 957 11/1975
JP 49-95046 8/1974

(Continued)

OTHER PUBLICATIONS

International Search Report dated Aug. 2, 2016.
Japanese Office Action dated Jul. 21, 2020.

*Primary Examiner* — Anthony D Stashick
*Assistant Examiner* — Raven Collins
(74) *Attorney, Agent, or Firm* — Gerald E. Hespos; Michael J. Porco; Matthew T. Hespos

(57) ABSTRACT

A container includes a container body; and a cap that locks onto the container body, the container body and the cap being locked by putting the cap on the container body. The cap includes a cap body, a cover cap being held on the cap body so as to be displaceable and rotatable, and an urging portion that upwardly urges the cover cap. When a rotational force is applied to the cover cap being downwardly pressed, the cap body is displaced in conjunction with the cover cap, so that locking between the cap body and the container body is released, and in a state where the cover cap is not downwardly pressed, the cap body is not displaced in conjunction with the cover cap even when a rotational force (Continued)

is applied to the cover cap, so that locking between the cap body and the container body is not released.

9 Claims, 14 Drawing Sheets

(52) U.S. Cl.
CPC .... *B65D 50/041* (2013.01); *B65D 2251/0015* (2013.01); *B65D 2251/0025* (2013.01)

(58) Field of Classification Search
CPC .. B65D 50/041; B65D 47/2043; B65D 47/12; B65D 2215/02; B65D 50/045; B65D 50/046; B65D 50/061
USPC ..... 215/329, 342
See application file for complete search history.

(56) References Cited

U.S. PATENT DOCUMENTS 3,027,035 A * 3/1962 Farago ..... B65D 50/041 215/219
3,795,338 A 3/1974 Swartzbaugh et al.
3,853,236 A 12/1974 Ostrowsky
3,917,098 A * 11/1975 Acton ..... B65D 50/041 215/219
10,974,877 B2 * 4/2021 Kim ..... B65D 47/18
2009/0250425 A1 * 10/2009 Yoshihiro ..... B65D 50/041 215/316
2011/0024426 A1 2/2011 Kokubo
2011/0278253 A1 * 11/2011 Goodall ..... B65D 41/0414 215/200
2014/0166608 A1 * 6/2014 Manera ..... B65D 41/06 215/211
2015/0244224 A1 * 8/2015 Kawashima ..... H02K 3/522 310/71

FOREIGN PATENT DOCUMENTS

JP 59-186250 12/1984
JP 3-97051 10/1991
JP 2002-145290 5/2002
JP 2006-335454 12/2006
JP 2008-030802 2/2008
JP 5314318 7/2013
WO 2013/190723 12/2013

* cited by examiner

CONTAINER

TECHNICAL FIELD

The present invention relates to a container for containing an eye drop, an oral medicine, a nose drop, a contact-lens cleaning solution or the like, and more specifically, to a container having a child resistance function.

BACKGROUND ART

There has been commonly known a container for an eye drop or the like which includes a container body having a nozzle, and a cap detachably attached to the container body, in which the cap is detached and a tip of the nozzle is oriented downward to drop a medical solution. In particular, a so-called twist cap-type container as recited in Japanese Patent No. 5314318 enables cap attachment/detachment to be conducted promptly compared to a conventional thread cap-type container. Specifically, while a locking arm is provided on an inner circumferential surface of a cap, a locking protrusion is provided on a container body, so that pressing the cap to the container body along a nozzle results in engaging the locking arm with the locking protrusion to lock (attach) the cap to the container body. Then, when the cap is twisted with respect to the container body, the cap gets on a shoulder portion (a boundary part between a liquid containing portion and a tubular neck portion which holds the nozzle) of the container body to release engagement between the locking arm and the container body, thereby detaching the cap from the container body.

In recent years, various kinds of containers for medicines and the like are recommended or demanded to be provided with a child resistance function for preventing erroneous use by a child (an infant). As is well known, child resistance function is a function of preventing children from easily using products. A twist cap-type container is convenient because of quick attachment/detachment of a cap as described in the foregoing and is thus easily attached/detached by children, and a child resistance function is therefore strongly required. Accordingly, a twist cap-type container is demanded to incorporate a child resistance function to prevent easy operation by a child without greatly impairing easiness of attachment/detachment.

SUMMARY OF INVENTION

An object of the present invention is to provide a twist cap-type container having a child resistance function.

Then, the container of the present invention includes a container body having an opening portion; and a cap which closes the opening portion and locks onto the container body, the container body and the cap being locked by putting the cap on the container body and pressing the cap toward a direction of the container body, in which the cap includes a cap body having a cap locking portion which locks the cap onto the container body, a cover cap which covers the cap body and is held on the cap body so as to be displaceable and rotatable in an up-down direction with respect to the cap body, and an urging portion which upwardly urges the cover cap, and when a rotational force is applied to the cover cap being downwardly pressed against an urging force of the urging portion, the cap body is displaced in conjunction with the cover cap, so that locking between the cap body and the container body is released, and in a state where the cover cap is not downwardly pressed against the urging force of the urging portion, the cap body is not displaced in conjunction with rotation of the cover cap even when a rotational force is applied to the cover cap, so that locking between the cap body and the container body is not released.

DESCRIPTION OF EMBODIMENTS

In the following, one preferred embodiment of the present invention will be described with reference to accompanying drawings.

[Overall Configuration]

Figure 1:
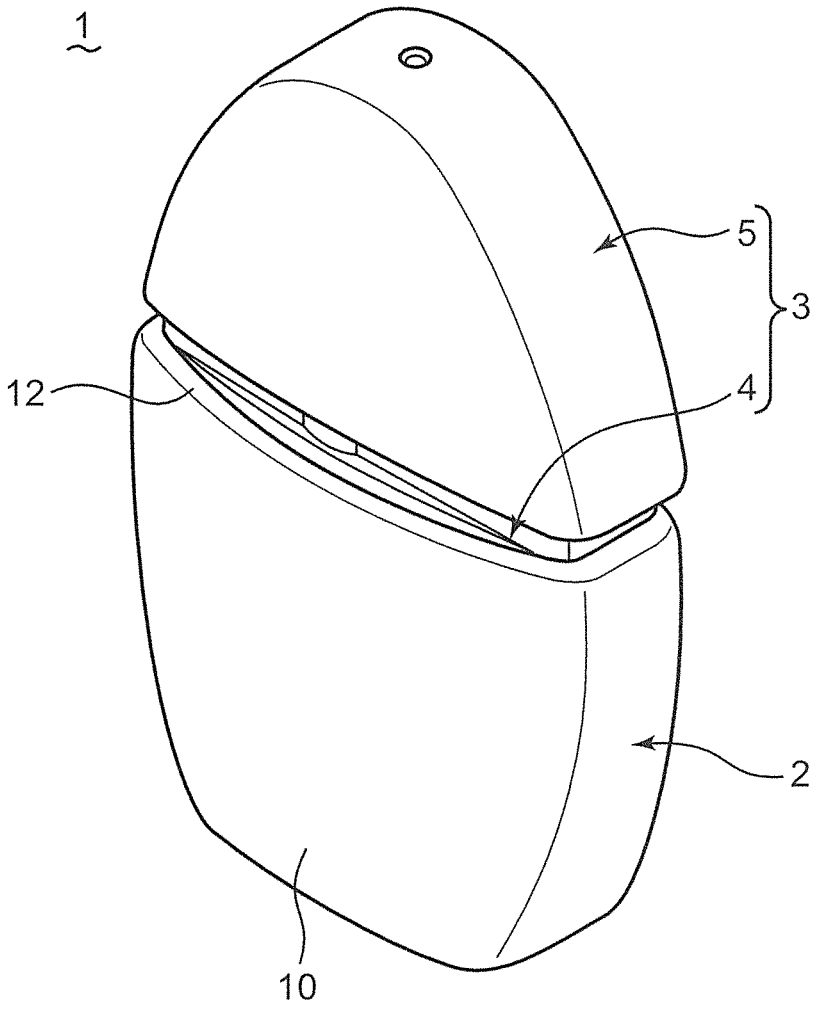
FIG. 1 is a perspective view of a container (eye drop container) according to an embodiment of the present invention.
Figure 2:
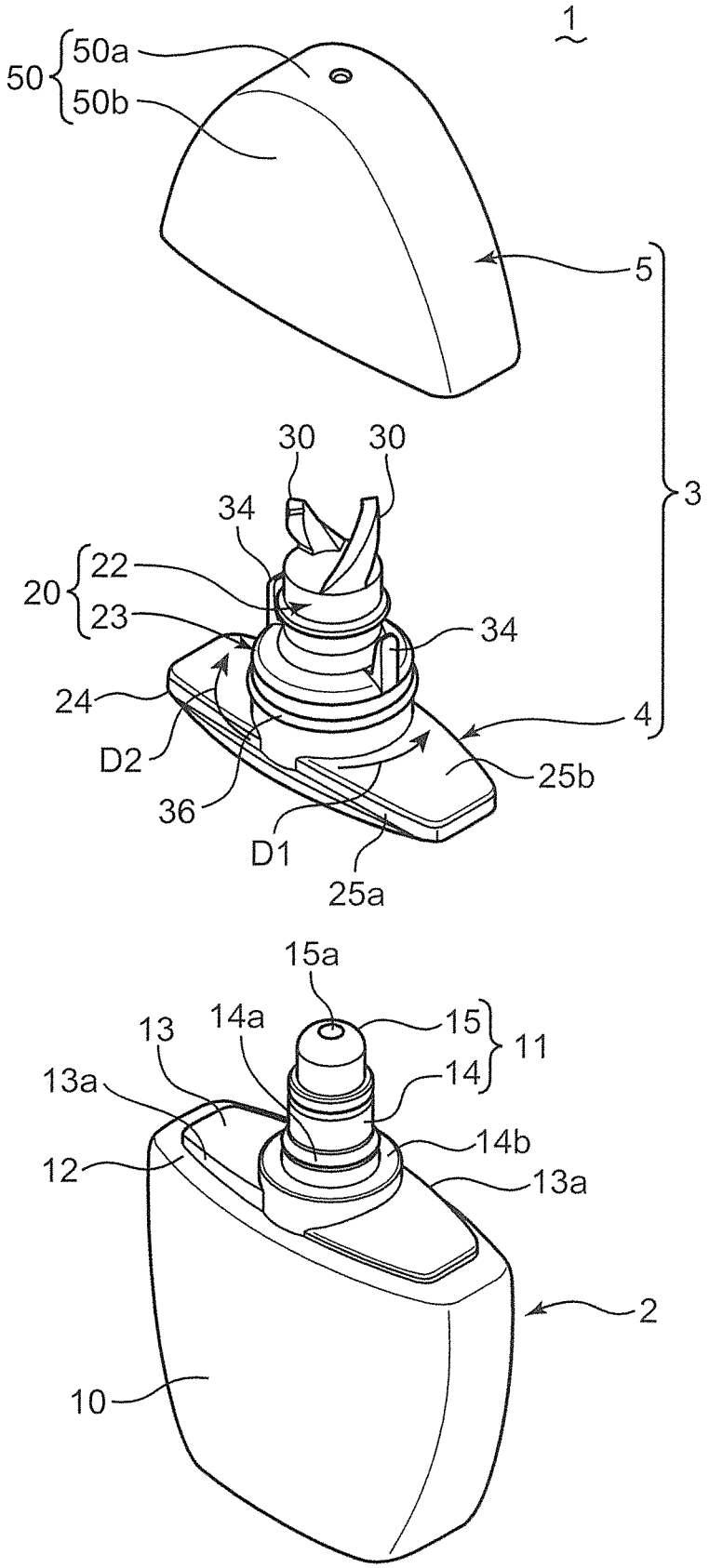
FIG. 2 is an exploded perspective view of the eye drop container.
Figure 3:
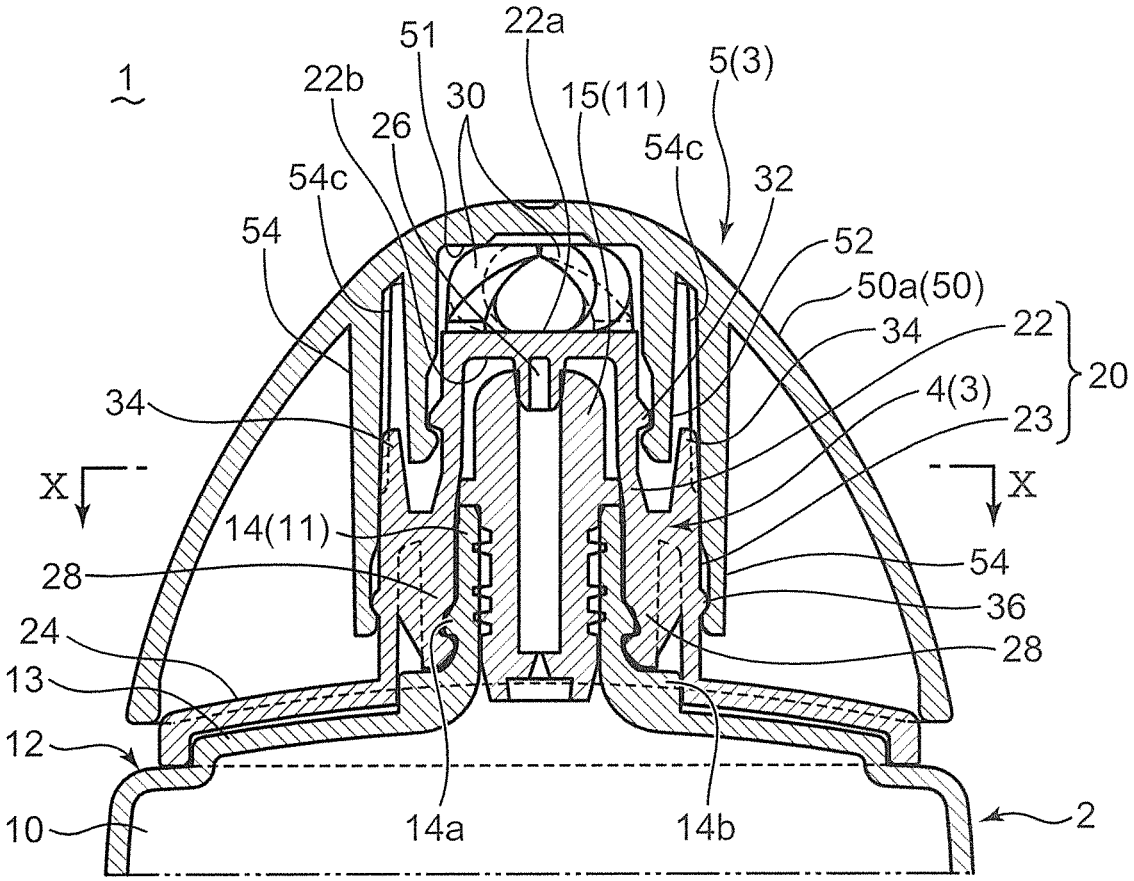
FIG. 3 is a sectional view of a main part of the eye drop container with a cap attached.
Figure 4:
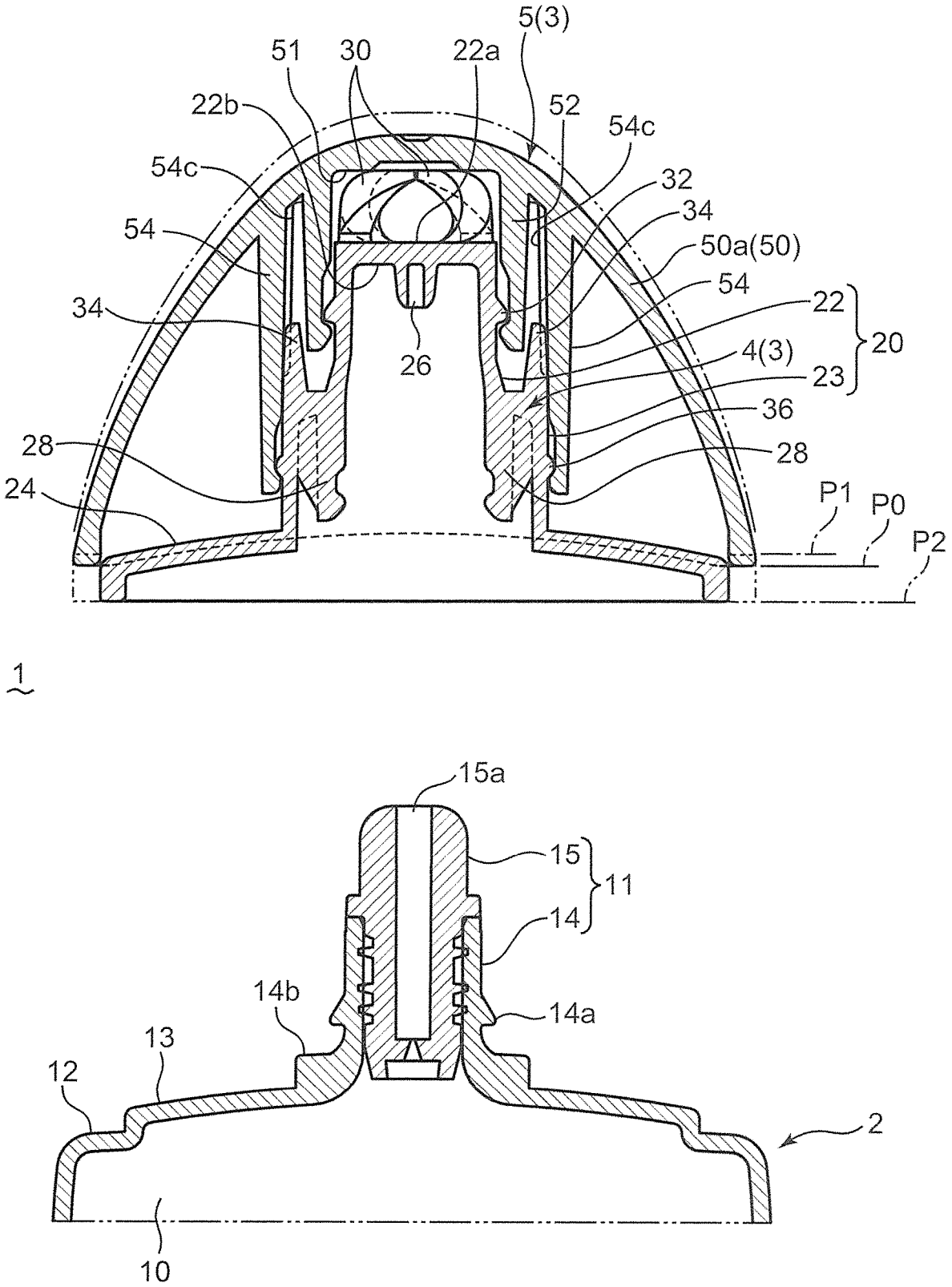
FIG. 4 is a sectional view of the main part of the eye drop container with the cap not attached.

FIG. 1 is a perspective view of an eye drop container which is one example of a container according to the present invention, and FIG. 2 is an exploded perspective view of the eye drop container. FIG. 3 is a sectional view of a main part of the eye drop container with a cap attached, and FIG. 4 is a sectional view of the main part of the eye drop container with the cap not attached.

As shown in FIG. 1 to FIG. 4, an eye drop container 1 includes a container body 2, and a cap 3 detachably attached to the container body 2. The eye drop container 1 is a so-called twist cap-type container of a flat shape having a generally rectangular section in its entirety.

Figure 7A:
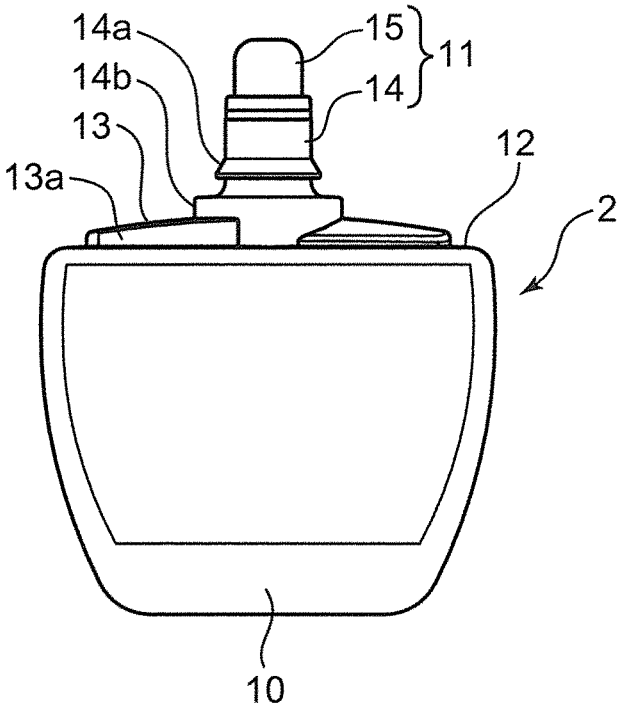
FIG. 7A is a front view of a container body.
Figure 7B:
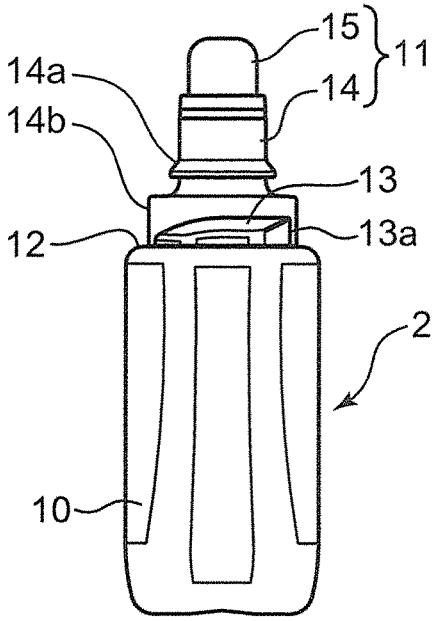
FIG. 7B is a side view of the container body.

As shown in FIG. 2, and FIGS. 7A and 7B, the container body 2 includes a medical solution containing portion 10 having a shoulder portion 12 at an upper end thereof, a tubular neck portion 14 having a cross-sectionally circular shape which is vertically arranged at the center of the shoulder portion 12, and a nozzle 15 inserted (fitted) in the tubular neck portion 14. The nozzle 15 is attached to the tubular neck portion 14 so as to have a tip portion thereof outwardly protruding from the tubular neck portion 14, and includes a nozzle port 15*a* at a tip end thereof. The tubular neck portion 14 and the nozzle 15 form a tubular extraction portion 11 for dropping an eye drop. In other words, the container body 2 includes the tubular extraction portion 11 extending in an up-down direction and having an opening portion (the nozzle port 15*a*) on a tip thereof, and the shoulder portion 12 continuous with a lower end of the tubular extraction portion 11.

In the container body 2, the medical solution containing portion 10 and the tubular neck portion 14 are integrally molded from the same transparent or semi-transparent resin material. As the material, a transparent synthetic resin such as polyethylene terephthalate, polypropylene, polycarbonate, or the like is suitably applied. On the other hand, the nozzle 15 is formed from a soft synthetic resin such as polyethylene, polypropylene, or the like.

As shown in FIG. 2 and FIGS. 7A and 7B, the medical solution containing portion 10 has a flat and generally rectangular solid shape, and the shoulder portion 12 includes a protrusion portion 13 (corresponding to a "guide portion" of the present invention) protruding upwardly. The protrusion portion 13 has an inclined surface extending upward obliquely toward the tubular neck portion 14 while forming a step on an upper surface of the shoulder portion 12.

The tubular neck portion 14 includes a ring-shaped locking protrusion 14*a* in the middle of an axial direction. The locking protrusion 14*a* is formed on an outer circumferential surface of the tubular neck portion 14 over the entire circumference for locking the cap 3.

The cap 3 closes the opening portion and locks onto the container body 2.

Specifically, the cap includes a cap body 4 which closes the nozzle port 15*a*, i.e., the opening portion at the tip of the tubular extraction portion 11, and a cover cap 5 held on the cap body 4 to cover the cap body 4 from outside. The cap 3 is put on the container body 2 and pressed toward a direction of the container body so as to be locked onto the container body 2. Specifically, the cap 3 is pressed to the container body 2 and is locked by putting the cap 3 on an upper portion of the container body 2 while inserting the tubular extraction portion 11 of the container body 2.

As shown in FIG. 2 to FIG. 5, the cap body 4 has a housing space which is surrounded by a wall portion configured with an inner surface and an outer surface and which houses therein an upper part of the container body 2. The cap body 4 includes a cylindrical hood portion 20 which surrounds the tubular extraction portion 11 to close the nozzle port 15*a*, and a base portion 24 outwardly extending from a lower end of the hood portion 20 and having a generally rectangular shape when viewed from the axial direction. The hood portion 20 and the base portion 24 are integrally molded from the same resin material, and suitably integrally molded from, for example, an elastically deformable resin material such as polypropylene, polyethylene, or the like.

The hood portion 20 sequentially includes a small diameter portion 22 mainly surrounding the tip portion (a part protruding from the tubular neck portion 14) of the nozzle 15, and a large diameter portion 23 having a diameter larger than that of the small diameter portion 22 and mainly surrounding the tubular neck portion 14, in this order from above. The hood portion 20 has a ceiling surface 22*b* in an inside upper portion thereof, on which ceiling surface 22*b*, a stopper portion 26 is provided to protrude downwardly. The stopper portion 26 is inserted into the nozzle port 15*a* in a liquid-tight manner, thereby closing the nozzle port 15*a* with the cap body 4.

The hood portion 20 includes, on the inside thereof, a pair of arm-shaped cap locking pieces 28 (corresponding to a "cap locking portion" of the present invention) suspending from an inside upper surface portion of the large diameter portion 23 to the proximity to an upper surface of a base end portion 14*b* of the tubular neck portion 14. The respective cap locking pieces 28 are opposed to each other with the tubular neck portion 14 of the container body 2 provided therebetween. Each of the cap locking pieces 28 has a cross-sectionally arc shape with an opposed surface along the outer circumferential surface of the tubular neck portion 14. The opposed surface of each cap locking piece 28 extends in the up-down direction and contacts the outer circumferential surface of the tubular neck portion 14. A hook 28*a* is formed at a tip end of each cap locking piece 28, and the hook 28*a* is engaged with the locking protrusion 14*a* of the tubular neck portion 14. This locks the cap body 4 onto the container body 2. In other words, the cap body 4 is arranged on the upper portion of the container body 2 such that the tubular extraction portion 11 (the tubular neck portion 14) is interposed between both the cap locking pieces 28, and the hook 28*a* of each cap locking piece 28 is locked to the locking protrusion 14*a*, whereby the cap body 4 is locked onto the container body 2.

Figure 5:
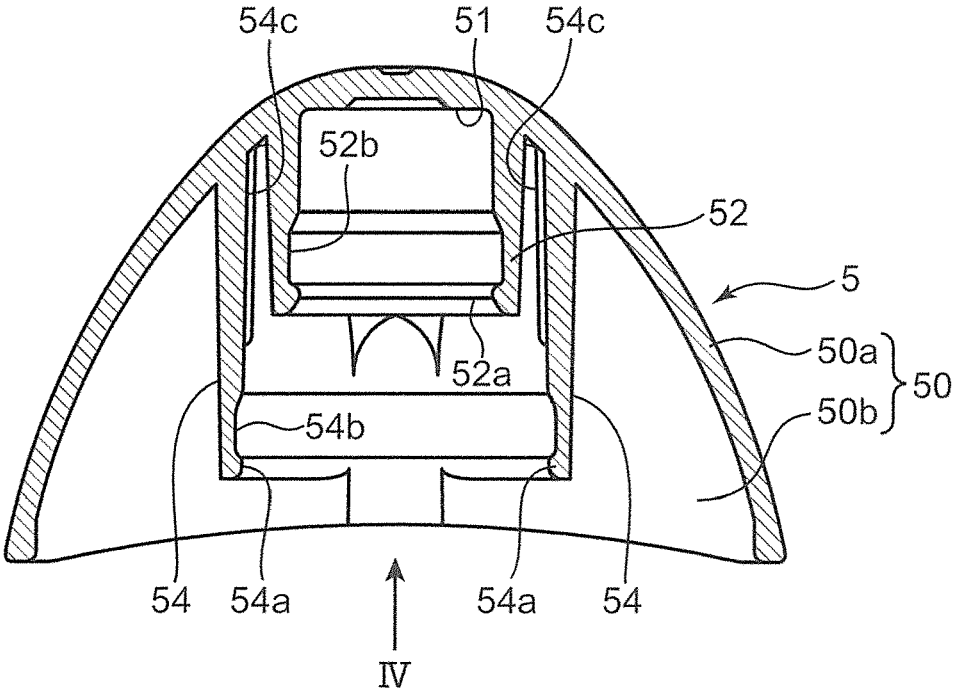
FIG. 5 is an exploded sectional view of the cap.
Figure 5:
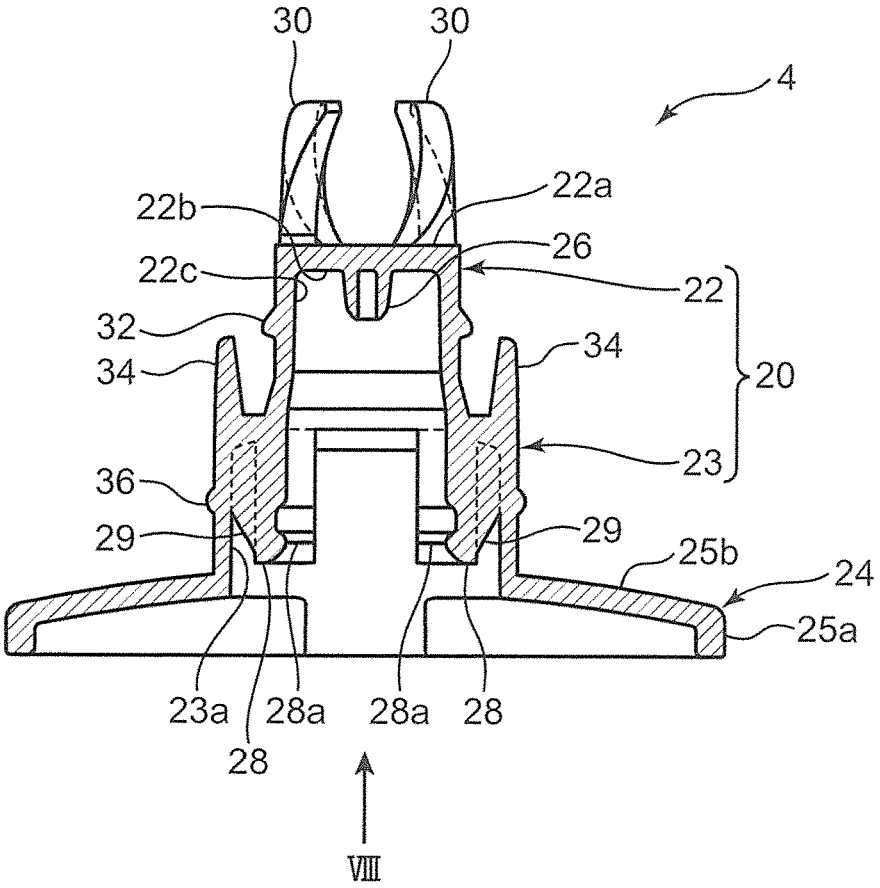
Figure 8:
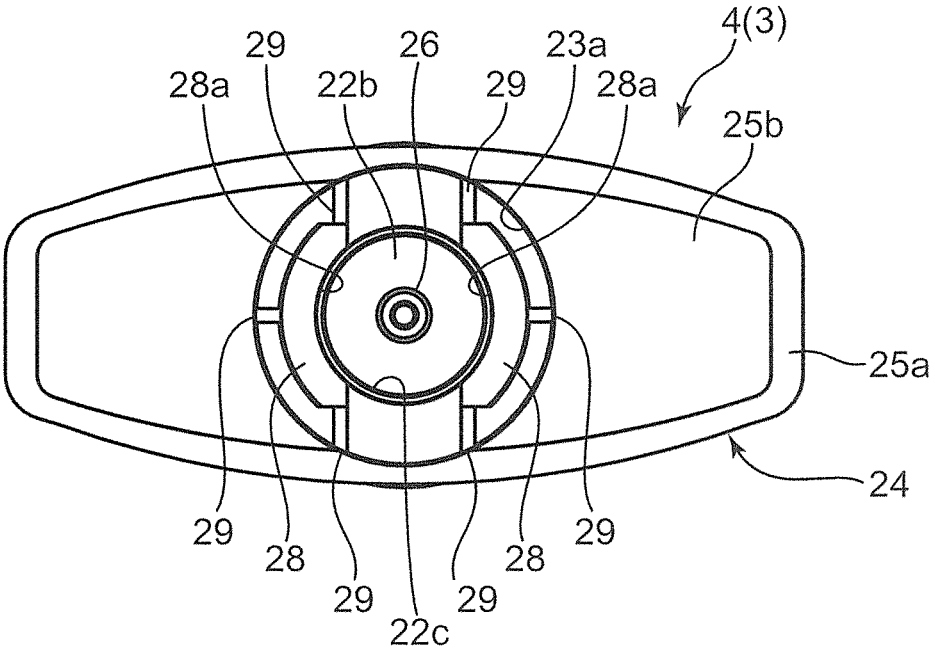
FIG. 8 is a bottom view (a view seen from a direction of VIII in FIG. 5) of a cap body.

As shown in FIG. 5 and FIG. 8, there is formed, in each gap between an inner circumferential surface 23*a* of the large diameter portion 23 of the hood portion 20 and each cap locking piece 28, a gap for allowing the cap locking piece 28 to be elastically displaced, i.e., a gap allowing the cap locking piece 28 to elastically bend and be displaced in a direction of separating at the time of engagement of the hook 28*a* with the locking protrusion 14*a* and at the time of releasing the engagement. However, between both ends and the center of the cap locking piece 28 in a width direction (the up-down direction in FIG. 8) and the inner circumferential surface 23*a* of the large diameter portion 23, plate-shaped ribs 29 extending in the up-down direction to link these portions are provided. This regulates the above bending displacement, so that the cap locking piece 28 and the locking protrusion 14*a* are relatively firmly engaged with each other.

The base portion 24 has a circumferential wall portion 25*a* configured with a pair of wall portions inwardly and outwardly opposed to side walls 50*b* of the cover cap 5 and a pair of wall portions provided continuously with the pair of wall portions and having a height relatively smaller than that of the pair of wall portions, and an upper wall portion 25*b* provided above and continuously with the circumferential wall portion 25*a*. Specifically, the base portion 24 has the circumferential wall portion 25*a* having a shape following a contour of the protrusion portion 13 of the shoulder portion 12 (an outer surface of the circumferential wall portion 25*a* corresponds to "an outer surface of the cap body" in "an inner surface opposed to an outer surface of the cap body" in the present invention, the outer surface of the circumferential wall portion 25*a* may be referred to as a "pressed portion" of the present invention in some cases, and one of the outer surfaces of the respective circumferential wall portions 25*a* in the pair of wall portions inwardly and outwardly opposed to the side walls 50*b* of the cover cap may be referred to as a "first pressed portion" of the present invention and the other may be referred to as a "second pressed portion" in some cases), and the upper wall portion 25*b* continuous with the circumferential wall portion 25*a*. The circumferential wall portion 25*a* is in contact with (externally fits to) a side surface of the protrusion portion 13.

As shown in FIG. 2 and FIGS. 7A and 7B, the protrusion portion 13 has a part which starts contacting along a rotational direction of the cover cap 5, and an upper part formed continuously with the former part and having a position which becomes higher in the up-down direction than the position of the former part. Specifically, the protrusion portion 13 has a part having the position (height) in the up-down direction gradually raised along the rotational direction of the cover cap 5. More specifically, as shown in FIG. 2 and FIGS. 7A and 7B, the protrusion portion 13 is formed to have a height gradually increasing counterclockwise (counterclockwise viewed from the top: the same applies hereinafter) with the tubular neck portion 14 as the center from one side to the other side. According to FIG. 7A, in the protrusion portion 13, a left part (referred to as a "first guide portion" of the present invention is some cases) of the tubular neck portion 14 has a height gradually increasing from a back side toward a front side in the plane of the drawing, and a right part (referred to as a "second guide portion" of the present invention is some cases) of the tubular neck portion 14 has a height gradually increasing from the front side toward the back side in the plane of the drawing. In other words, in the protrusion portion 13, an upper surface of the left part of the tubular neck portion 14 is formed to be an inclined surface whose height is gradually increased from the back side toward the front side in the plane of the drawing, and an upper surface of the right part of the tubular neck portion 14 is formed to be an inclined surface whose height is gradually increased from the front side toward the back side in the plane of the drawing. In this manner, of the protrusion portion 13, regulation surfaces 13*a* (corresponding to a "regulating portion" of the present invention) are formed one, in the left part of the tubular neck portion 14, on the front side in the plane of the drawing and the other, in the right part of the tubular neck portion 14, on the back side in the plane of the drawing, each regulation surface coming into contact with the circumferential wall portion 25*a* of the base portion 24 to prevent the cap body 4 from rotating. In other words, the protrusion portion 13 is formed to allow the base portion 24 to relatively easily get on the protrusion portion 13 when a counterclockwise (corresponding to a direction of an arrow D1 in FIG. 2; a "first direction" in the present invention) rotational force is applied to the cap body 4, while preventing the base portion 24 from rotating by the regulation surface 13*a* when a clockwise (corresponding to a direction of an arrow D2 in FIG. 2; a "second direction" in the present invention) rotational force is applied to the cap body 4, thereby regulating the base portion 24 from getting on the protrusion portion 13.

The cover cap 5 is arranged outside the cap body. The cover cap 5 has a housing space which is surrounded by a wall portion configured with an inner surface and an outer surface and which houses inside an upper part of the cap body. As shown in FIG. 2 to FIG. 5, the cover cap 5 is configured with the pair of side walls 50*b* opposed to each other in a horizontal direction with the cap body 4 interposed therebetween, and a ceiling wall 50*a*, each of the pair of side walls 50*b* having an inner surface and an outer surface. More specifically, as shown in FIG. 2 to FIG. 5, the cover cap 5 includes a cover cap body 50 having the crest-type ceiling wall 50*a* and the side walls 50*b* on both sides of the ceiling wall 50*a* (the inner surface of the side wall 50*b* corresponds to "the inner surface opposed to the outer surface of the cap body" in the present invention, the inner surface of the side wall 50*b* is referred to as a "pressing portion" of the present invention in some cases, and one of the pair of side walls 50*b* opposed to each other via the cap body 4 is referred to as a "first pressing portion" of the present invention and the other as a "second pressing portion" of the present invention), cylindrical inner locking pieces 52 each suspending from a lower surface (a ceiling surface 51) of the ceiling wall 50*a*, and outer locking pieces 54 each continuous with each side wall 50*b*, and the cover cap 5 has a flat shape similarly to the container body 2.

The cover cap 5 is integrally molded in its entirety from a similar resin material to that of the cap body 4. In other words, the cover cap body 50, the inner locking piece 52, and the outer locking pieces 54 are integrally molded from the above resin material.

Figure 9:
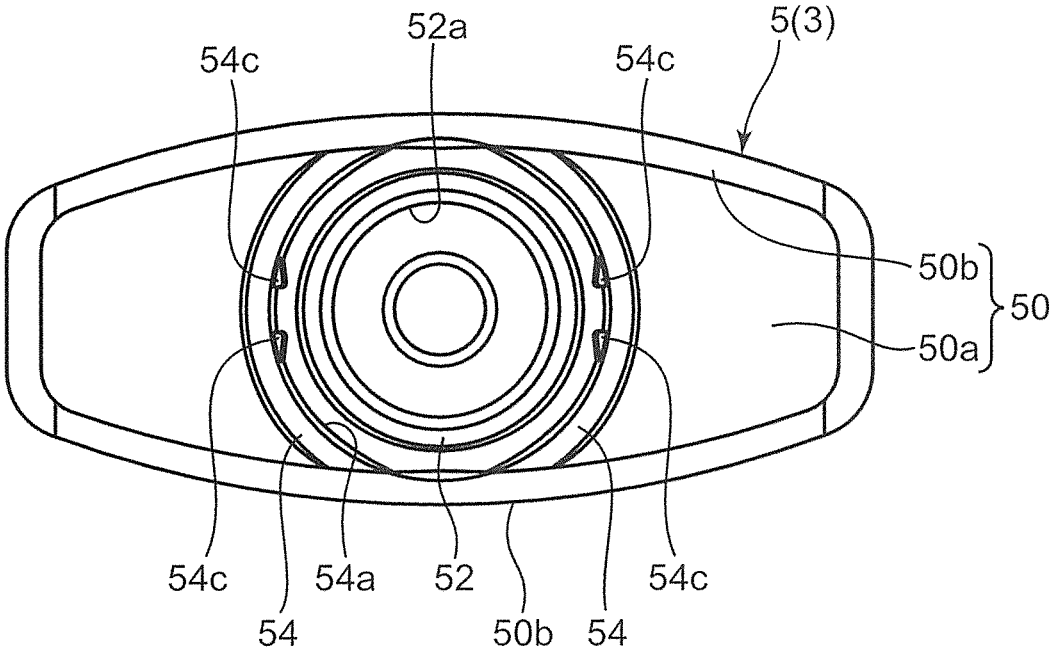
FIG. 9 is a bottom view (a view seen from a direction of IX in FIG. 5) of the cover cap.

As shown in FIG. 5 and FIG. 9, the inner locking pieces 52 are arranged at the center of the ceiling surface 51, and the outer locking pieces 54 are arranged around the inner locking piece 52 as the center.

As shown in FIG. 4, the inner locking piece 52 is externally fitted to the small diameter portion 22 of the hood portion 20 so as to be rotatable with the small diameter portion 22 as the center and displaceable in the up-down direction. Specifically, the inner locking piece 52 has an inner diameter which enables slidable contact with an outer circumferential surface of the small diameter portion 22 of the hood portion 20.

A ring-shaped recess 52*b* is formed over the entire circumference of an inner circumferential surface of the inner locking piece 52, the inner circumferential surface being slightly upward of a tip end (a lower end) of the inner locking piece 52. This results in forming a ring-shaped hook portion 52*a* over the entire circumference of the tip end of the inner locking piece 52. The hook portion 52*a* is engaged with a ring-shaped locking protrusion 32 formed on the outer circumferential surface of the small diameter portion 22, thereby locking (holding) the cover cap 5 to the cap body 4.

The recess 52*b* of the inner locking piece 52 has a width size (a width size in the up-down direction) which allows the locking protrusion 32 to be relatively displaced in the up-down direction within a fixed range, i.e., allows the cover cap 5 to be displaced in the up-down direction with respect to the cap body 4. Specifically, as shown in FIG. 4, the recess 52*b* has a width size which allows the cover cap 5 to be displaced in the up-down direction over an ascending end position P1 at which a lower end portion of the cover cap 5 (the cover cap body 50) is located above the base portion 24 of the cap body 4, and a descending end position P2 (see FIG. 6) at which the lower end portion of the cover cap 5 externally fits (covers) the base portion 24 of the cap body 4.

As described above, the hook portion 52*a* is formed over the inner circumferential surface of the cylindrical inner locking piece 52, and the locking protrusion 32 is formed over the entire circumference of the small diameter portion 22. Therefore, locking between the hook portion 52*a* of the cover cap 5 and the locking protrusion 32 of the cap body 4 is realized, for example, by insertion of an upper end of the hood portion 20 into the inner locking piece 52, and by application, in this state, of a considerably strong external force in the up-down direction to the cover cap 5 and the cap body 4. Accordingly, the engagement between the hook portion 52*a* and the locking protrusion 32 is firm to an extent that release of the engagement by a person using an external force is difficult. In other words, the cover cap 5 is held on the cap body 4 so as to be substantially inseparable by a person.

The hood portion 20 of the cap body 4 has a pair of elastic bending pieces 30 (corresponding to an urging portion of the present invention) extending upwardly from an upper end surface 22*a* of the hood portion 20. The pair of elastic bending pieces 30 is spirally formed to extend upwardly while turning around a central axis of the upper end surface 22*a* counterclockwise viewed from the top. As shown in FIG. 3, these elastic bending pieces 30 are interposed while being compressed in the up-down direction between the upper end surface 22*a* of the hood portion 20 and the ceiling surface 51 of the cover cap 5 (the cover cap body 50). This upwardly urges the cover cap 5 with respect to the cap body 4 by a resilient force of the elastic bending pieces 30, i.e., toward the ascending end position P1.

The outer locking pieces 54 are continuous with the side walls 50*b*, and have an inner circumferential surface concentric with the inner locking piece 52 as shown in FIG. 9, and the outer locking pieces 54 are externally fitted to the large diameter portion 23 of the hood portion 20 so as to be rotatable around the large diameter portion 23 and displaceable in the up-down direction as shown in FIG. 4. In other words, the outer locking pieces 54 have an inner diameter which enables slidable contact with an outer circumferential surface of the large diameter portion 23 of the hood portion 20.

As shown in FIG. 3 to FIG. 5, a recess 54*b* is formed on the inner circumferential surface of the outer locking pieces 54 over a width direction thereof (in the up-down direction in FIG. 9), the inner circumferential surface being slightly upward of a tip end (a lower end) of the outer locking piece 54. This results in forming a hook portion 54*a* at the tip end of the outer locking piece 54. The hook portion 54*a* is engaged with a ring-shaped locking protrusion 36 formed on the outer circumferential surface of the large diameter portion 23 of the hood portion 20.

By the engagement therebetween, the hook portion 54*a* and the locking protrusion 36 lock (hold) the cover cap 5 at a temporary engagement position P0 between the ascending end position P1 and the descending end position P2. As shown in FIG. 4, the temporary engagement position P0 is a position at which the cover cap 5 externally fits the base portion 24 of the cap body 4 more lightly than at the descending end position P2. Specifically, as described above, because of engagement of the hook portion 54*a* with the locking protrusion 36, the cover cap 5 is held at the temporary engagement position P0 downward of the ascending end position P1 while being urged toward the ascending end position P1 by the resilient force of each of the elastic bending pieces 30. This positions the cover cap 5 in the rotational direction thereof with respect to the cap body 4. Specifically, a side surface of the cover cap 5 and a side surface of the medical solution containing portion 10 are positioned at substantially continuous positions (see FIG. 1). In this example, the lower end portion of the cover cap 5 and the base portion 24 of the cap body 4 to which the lower end portion of the cover cap 5 lightly externally fits correspond to a "positioning portion" of the present invention.

The recess 54*b* of the outer locking piece 54 has a width size which allows the locking protrusion 36 to be displaced relatively in the up-down direction within a fixed range, i.e., to allow the cover cap 5 to be displaced over the temporary engagement position P0 and the descending end position P2. When the cover cap 5 is arranged at the ascending end position P1, the hook portion 54*a* slightly gets on the locking protrusion 36 to elastically deform the outer locking piece 54 (see FIG. 4), thereby urging the cover cap 5 toward the temporary engagement position P0.

Figure 10:
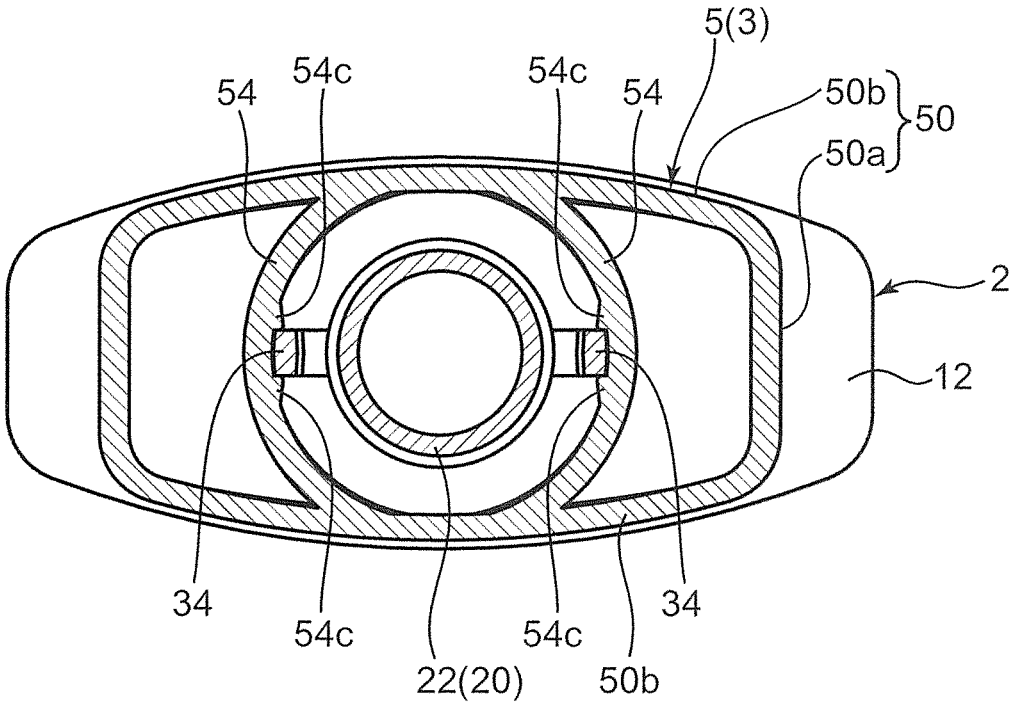
FIG. 10 is a sectional view (a sectional view taken along line X-X in FIG. 3) of the eye drop container.

A pair of rail portions 34 is formed in the large diameter portion 23 of the hood portion 20 of the cap body 4 as shown in FIG. 2 to FIG. 5. These rail portions 34 are protrusion pieces which extend upwardly and straightly from an upper end surface of the large diameter portion 23 and arranged on both sides of the small diameter portion 22 in a direction parallel to a longitudinal direction of the base portion 24. On the other hand, as shown in FIG. 9 and FIG. 10, a pair of guide ribs 54*c* is provided on the inner circumferential surface of the outer locking pieces 54 of the cover cap 5, the guide ribs 54*c* sandwiching the rail portions 34 from both sides to guide the rail portions 34 in the up-down direction. This results in positioning the cover cap 5 in the rotational direction thereof with respect to the cap body 4, to be specific, positioning the side surface of the cover cap 5 and the side surface of the medical solution containing portion 10 at substantially continuous positions (see FIG. 1), while stably enabling the cover cap 5 to be displaced in the up-down direction over the ascending end position P1 and the descending end position P2 with respect to the cap body 4. In this example, the rail portions 34 and the guide ribs 54*c* correspond to the "positioning portion" of the present invention. In other words, as a structure for positioning the cover cap 5 in the rotational direction, this example adopts a double structure for positioning by the rail portions 34 and the guide ribs 54*c* and positioning realized by externally fitting the cover cap 5 to the base portion 24. In this example, these positioning each corresponds to the "positioning portion" of the present invention.

The pair of guide ribs 54*c* allows rotation of the cover cap 5 when a rotation operation force not less than a fixed value is applied to the cover cap 5, i.e., a protrusion size of the guide ribs 54*c* from the inner circumferential surface of the outer locking pieces 54 is set to an extent that the guide ribs 54*c* can go over the rail portions 34.

[Functions and Effects, etc.]

Figure 11:
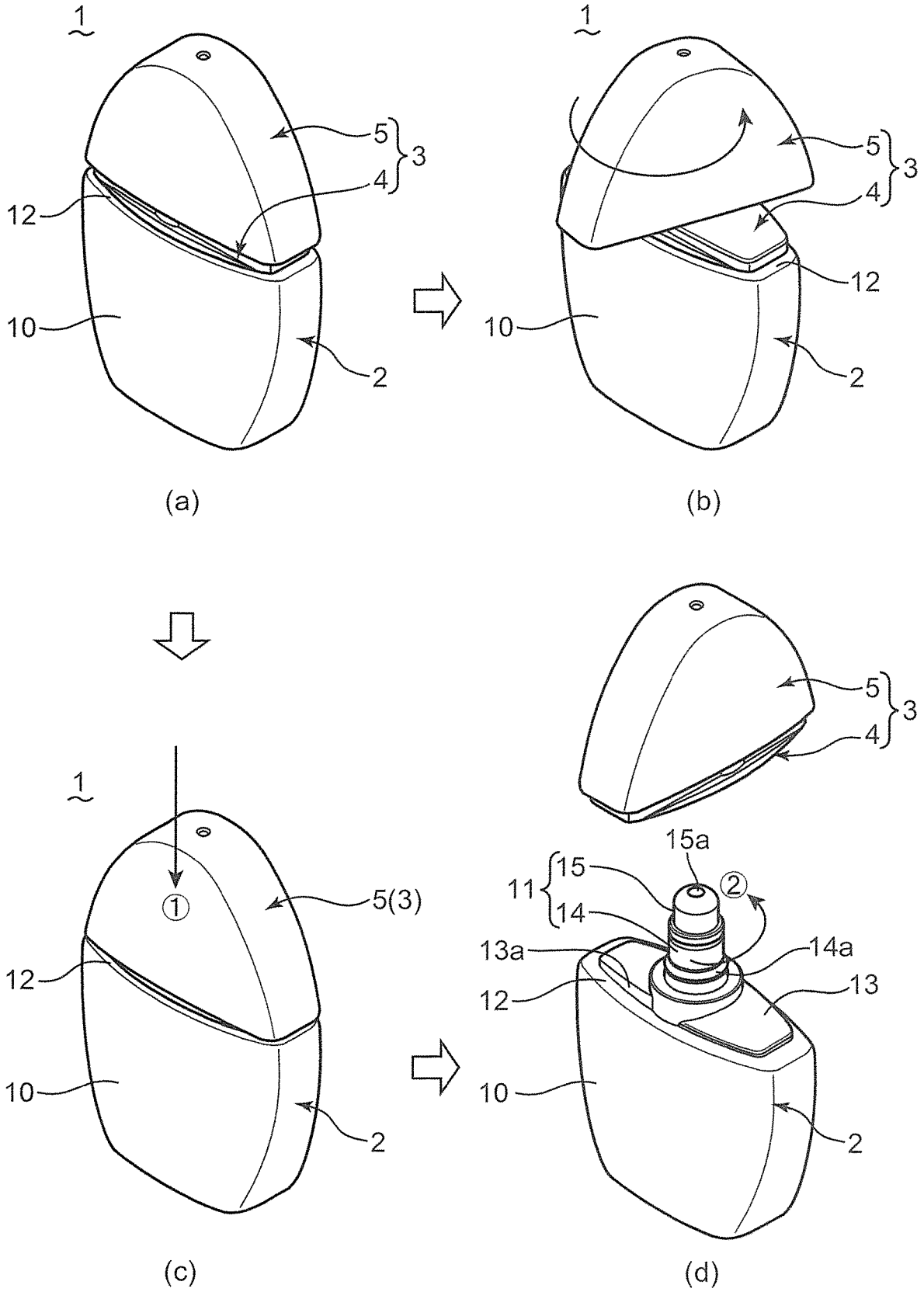
FIG. 11 is a view for explaining a method of detaching the cap of the eye drop container.

With reference to FIG. 11, description will be made of a method of using the eye drop container 1.

In FIG. 11, section (a) shows a state where the cap 3 is attached, i.e., a state of the eye drop container 1 when not used, the state being shown in FIG. 1 and FIG. 3.

At the time of instillation, the cap 3 (the cover cap 5) is detached from the container body 2 by grasping the container body 2 and the cap 3 and rotating the cap 3 around the tubular extraction portion 11 by approximately 30° to 50°. In this case, since the cover cap 5 not being pressed downwardly against an urging force of the elastic bending pieces 30 is held at the temporary engagement position P0, i.e., at the position at which the cover cap 5 lightly fits the base portion 24 of the cap body 4 as described above, simply applying a rotational force to the cover cap 5 might cause the cover cap 5 to get on the base portion 24 of the cap body 4 to rotate with respect to the cap body 4 while being displaced to the ascending end position P1. In other words, in this case, the cover cap 5 only turns free with respect to the cap body 4, but the cap 3 will not be detached from the container body 2 as shown in section (b) of FIG. 11.

In the state shown in section (a) of FIG. 11, in which the rail portions 34 of the cap body 4 (the hood portion 20) are interposed between the pair of guide ribs 54*c* of the cover cap 5, the guide ribs 54*c* go over the rail portions 34 as a result of application of the rotational force to the cover cap 5, so that the cover cap 5 rotates with respect to the cap body 4.

On the other hand, as indicated by circled numerals 1 and 2 in section (c) and section (d) of FIG. 11, first, in the state shown in section (a) of FIG. 11, the cover cap 5 is pressed downwardly against an urging force of the elastic bending pieces 30, specifically, the cover cap is pressed against the urging force of the elastic bending pieces 30 to be pushed down to the descending end position P2, and in this state, when the cover cap 5 is rotated, the cap body 4 is rotated together with the cover cap 5 to detach the cap 3 from the container body 2.

Figure 6:
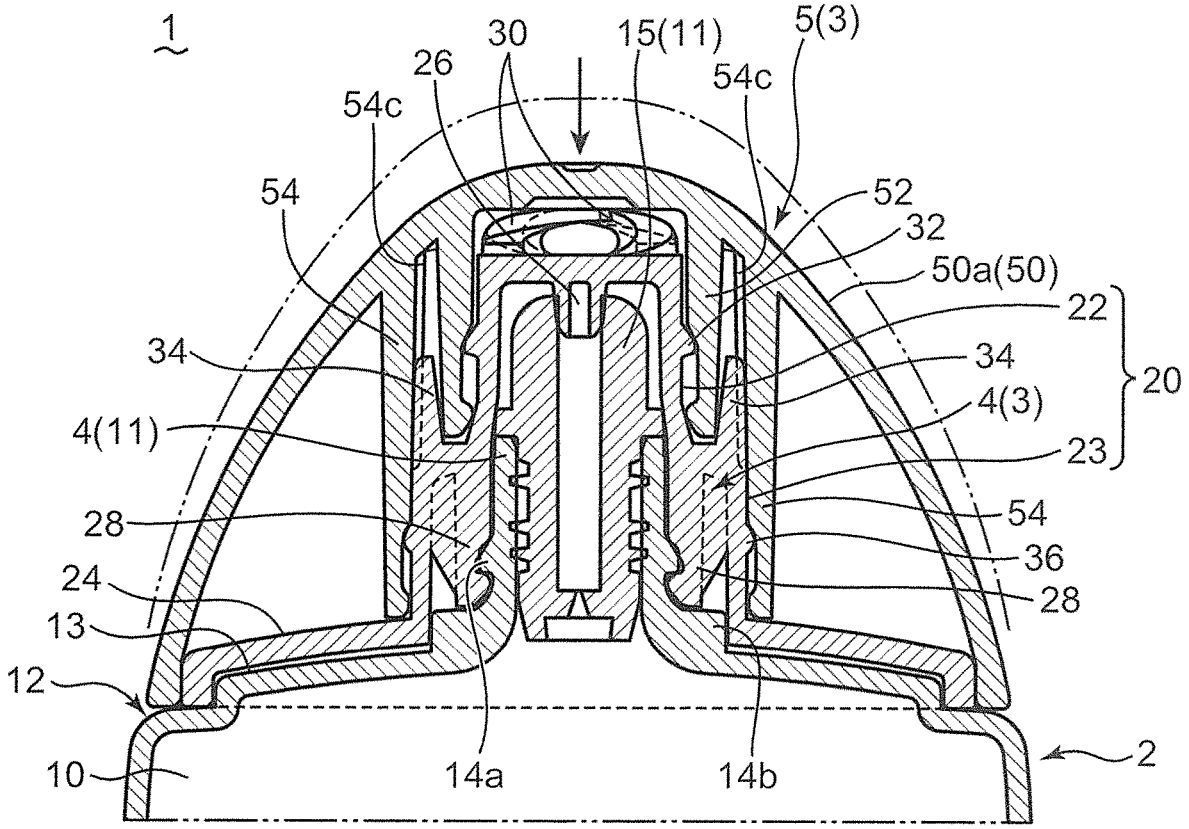
FIG. 6 is a sectional view of the main part of the eye drop container in a state where a cover cap is pressed to a descending end position.

To be described in more detail, when the cover cap 5 is pushed down from the temporary engagement position P0 to the descending end position P2, the cover cap 5 (the cover cap body 50) externally fits the base portion 24 of the cap body 4 as shown in FIG. 6. Therefore, when the cover cap 5 is rotated counterclockwise (in the direction of the arrow D1 in FIG. 2) in this state, because the base portion 24 of the cap body 4 is located on a moving track of the lower end portion of the cover cap 5, the cover cap 5 presses the cap body 4 (in more detail, each lower end portion of the pair of side walls 50*b* in the cover cap 5 presses the pair of wall portions in the cap body 4 which are inwardly and outwardly opposed to the lower end portion), the cover cap 5 and the cap body 4 integrally rotate counterclockwise in conjunction with each other, and following the rotation, the base portion 24 gets on the protrusion portion 13 of the container body 2 (in more detail, of the base portion 24, one part and the other part arranged to be opposed to each other via the hood portion 20 will get on each protrusion portion 13 contacting thereto). Then, as a result of upward displacement of the cap body 4 by the getting-on, the engagement state between the cap locking piece 28 of the cap body 4 and the locking protrusion 14*a* of the container body 2 is released, resulting in detaching the cap 3 from the container body 2.

After detachment of the cap 3, an eye drop is dropped from a nozzle tip by holding the container body 2 upside down and lightly squeezing the medical solution containing portion 10 in the same manner as a common eye drop container.

Then, after use of the eye drop, the cap 3 is put on the upper portion of the container body 2 while inserting the tubular extraction portion 11 of the container body 2 into the hood portion 20 of the cap body 4, and the cap 3 is lightly pressed to the container body 2. In this manner, the cap locking piece 28 of the cap body 4 is engaged with the locking protrusion 14*a* of the tubular extraction portion 11, resulting in locking the cap 3 onto the container body 2 to enter an original state where the cap 3 is attached to the container body 2.

Thus, in the eye drop container 1, merely applying a rotational force to the cap 3 while grasping the container body 2 and the cap 3 (the cover cap 5) only causes the cover cap 5 to turn free with respect to the cap body 4, but does not allow the cap 3 to be detached. Accordingly, it is possible to prevent a child (an infant) from holding the eye drop container 1 by hand to detach the cap 3 from the eye drop container 1. In particular, in the eye drop container 1, since the cap locking piece 28 of the cap body 4 and an inner circumferential surface of the hood portion 20 (the large diameter portion 23) are linked via the plurality of ribs 29, bending displacement of the cap locking piece 28 is regulated. In other words, there is provided a structure in which the engagement state between the cap locking piece 28 of the cap body 4 and the locking protrusion 14*a* of the container body 2 is hard to be released only by grasping and pulling the cap 3 and the container body 2 in directions separating from each other. Therefore, also in this respect, it is possible to prevent a child (an infant) from detaching the cap 3.

On the other hand, as shown in the circled numerals 1 and 2 in section (b) and section (c) of FIG. 11, when the cover cap 5 is pushed down to the descending end position P2, and the cover cap 5 is rotated in this state, getting-on of the base portion 24 to the protrusion portion 13 enables the engagement state between the cap locking piece 28 and the locking protrusion 14*a* to be relatively easily released. Thus, the cap 3 can be detached from the container body 2. Such operation can be conducted with ease even by an elderly person if he or she knows a method thereof. Moreover, operation of attaching/detaching the cap 3 to/from the container body 2 is equivalent to that of a common twist cap-type eye drop container except for pushing-down operation of the cover cap 5. Accordingly, the eye drop container 1 has an advantage of allowing a twist cap-type eye drop container to have a child resistance function without greatly impairing easiness of attaching/detaching the cap 3.

Also, according to the eye drop container 1, in the cap body 4, the base portion 24 is allowed to get on the protrusion portion 13 only when rotated counterclockwise (in the direction of the arrow D1 in FIG. 2), and rotation of the base portion 24 is prevented by the regulation surface 13*a* when rotated clockwise (in the direction of the arrow D2 in FIG. 2), thereby regulating getting-on of the base portion 24 to the protrusion portion 13. In other words, the cap 3 is allowed to be detachable only when rotated counterclockwise.

Accordingly, the eye drop container 1 has an advantage of realizing a higher child resistance function. Specifically, with such a twist cap-type flat container as the eye drop container 1, for example, when a right-handed user is to detach the cap 3, it is ergonomically a common practice to grasp the container body 2 by a left hand and the cap 3 by a right hand to laterally hold the container so as to have a flat surface in the up-down direction, and rotate the cap 3 in a pushing-out direction (i.e., clockwise; in the direction of the arrow D2 in FIG. 2). In this regard, the eye drop container 1 enables detachment of the cap 3 only when the cap 3 is rotated counterclockwise (in the direction of the arrow D1 in FIG. 2) as described above. Therefore, it is possible to effectively prevent detachment of the cap 3 in a case where a child (an infant) unconsciously rotates the cap 3. Accordingly, the eye drop container 1 realizes a higher child resistance function. Even with a twist cap-type container, in a case where the container has not a flat shape but, for example, a cylindrical shape or the like, it is ergonomically suitable to enable the cap 3 to be detached only when rotated in a direction opposite to the above direction.

Additionally, with the eye drop container 1, the cover cap 5 is held at the temporary engagement position P0, i.e., at a position at which the cover cap 5 lightly fits the base portion 24 of the cap body 4, thereby positioning the cover cap 5 in the rotational direction. In other words, the cover cap 5 not being pressed downwardly against an urging force of the elastic bending pieces 30 is positioned in the rotational direction of the cover cap 5 by contacting between the cover cap 5 and the cap body 4 in the rotational direction of the cover cap 5. Specifically, as the cover cap 5 rotates with respect to the cap body 4, the inner surface of the side wall 50*b* of the cover cap 5 contacts the outer surface of the circumferential wall portion 25*a* of the base portion 24 in the cap body 4, thereby positioning the cover cap 5 in the rotational direction of the cover cap 5. When a rotation angle of the cover cap 5 is increased, after the cover cap 5 contacts the cap body 4, the cover cap 5 gets on an upper surface of the base portion 24 and the cover cap 5 is displaced upwardly, thereby releasing positioning. Further, in the eye drop container 1, while the cap body 4 (the hood portion 20) is provided with the pair of rail portions 34, the pair of guide ribs 54*c* is formed in the cover cap 5, the guide ribs 54*c* sandwiching each of the rail portions 34 from both sides and guiding the same in the up-down direction, which also results in positioning the cover cap 5 in the rotational direction. In other words, the eye drop container 1 has a second positioning portion in which the cover cap 5 and the cap body 4 contact with each other in the rotational direction of the cover cap 5 to position the cover cap 5 in the rotational direction of the cover cap 5. Specifically, as the cover cap 5 rotates with respect to the cap body 4, the guide ribs 54*c* of the cover cap 5 contact the rail portions 34 of the cap body 4 to position the cover cap 5 in the rotational direction of the cover cap 5. When the rotation angle of the cover cap 5 with respect to the cap body 4 is increased, after the guide ribs 54*c* of the cover cap 5 contact the rail portions 34, the guide ribs 54*c* elastically deform outwardly to release the positioning. Accordingly, there is provided another advantage of preventing the rotation of the cover cap 5 to an unintended position with respect to the cap body 4, which impairs operability at the time of detaching the cap or designability.

[Other Modification etc.]

The eye drop container 1 is an illustrative example of a preferred embodiment of the container according to the present invention, and a specific configuration thereof can be appropriately modified without departing from the gist of the present invention. A following configuration, for example, can be adopted.

Figure 12A:
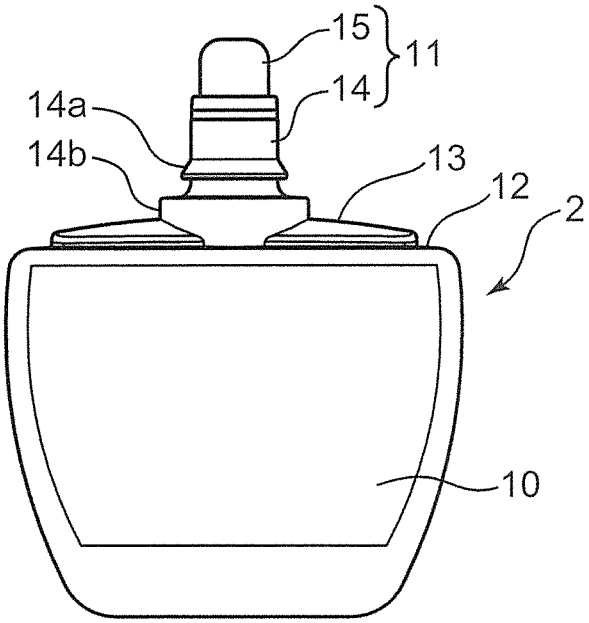
FIG. 12A is a front view of a container body according to a modification.
Figure 12B:
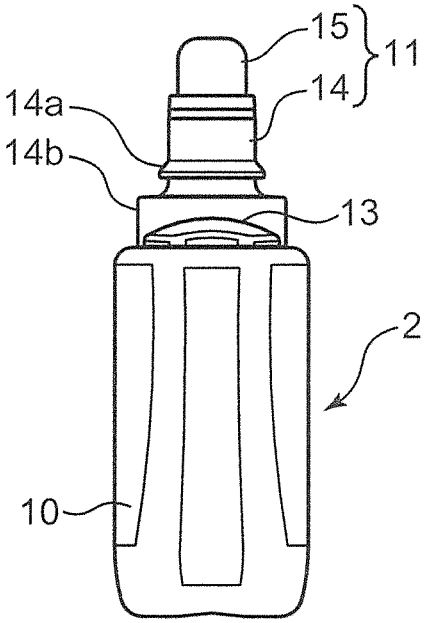
FIG. 12B is a side view of the container body according to the modification.

(1) The protrusion portion 13 (the shoulder portion 12) of the container body 2 is formed to allow the base portion 24 to get on the protrusion portion 13 only when the cap body 4 rotates counterclockwise (in the direction of the arrow D1 in FIG. 2), and to regulate getting-on of the base portion 24 to the protrusion portion 13 when the cap body 4 rotates clockwise (in the direction of the arrow D2 in FIG. 2). However, the protrusion portion 13 (the shoulder portion 12) may be configured such that the base portion 24 gets on the protrusion portion 13 whichever direction the cap body 4 rotates. Specifically, as shown in FIGS. 12A and 12B, the protrusion portion 13 may be formed to be the highest at a central portion thereof in a width direction thereof (a right and left direction in FIG. 12B) and lower at both ends. In other words, the regulation surface 13*a* may be omitted from the protrusion portion 13.

Figure 13:
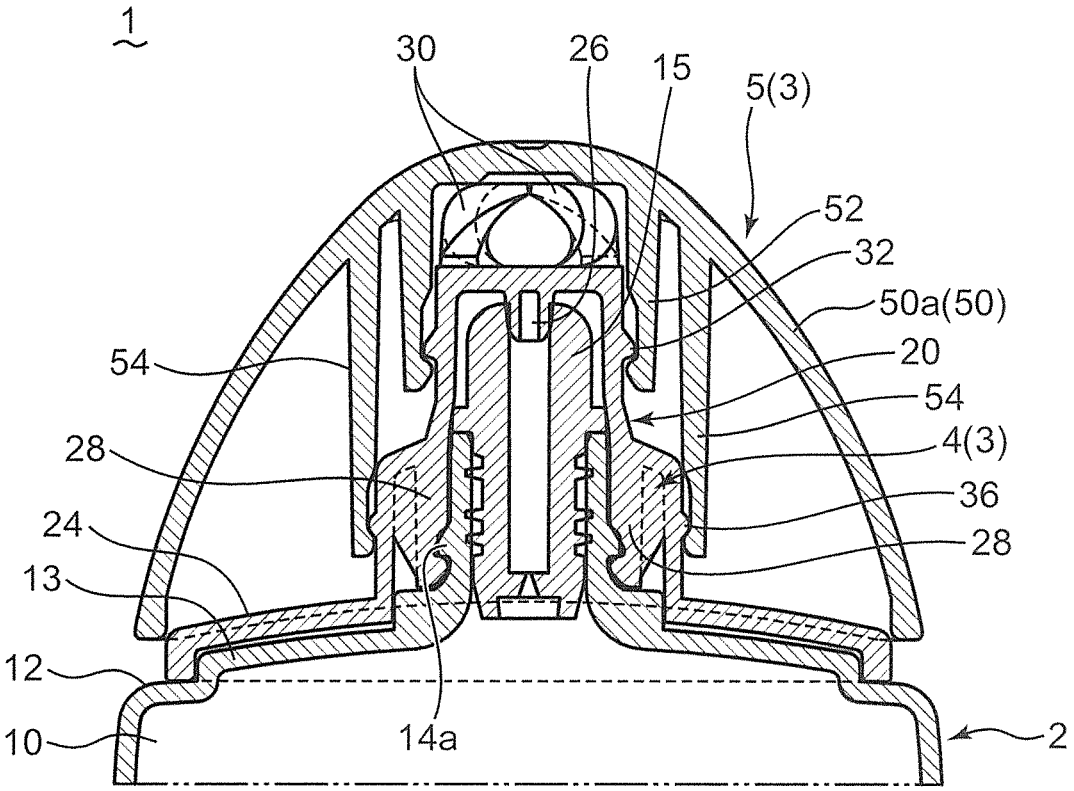
FIG. 13 is a sectional view of a main part of an eye drop container according to another modification.
Figure 14:
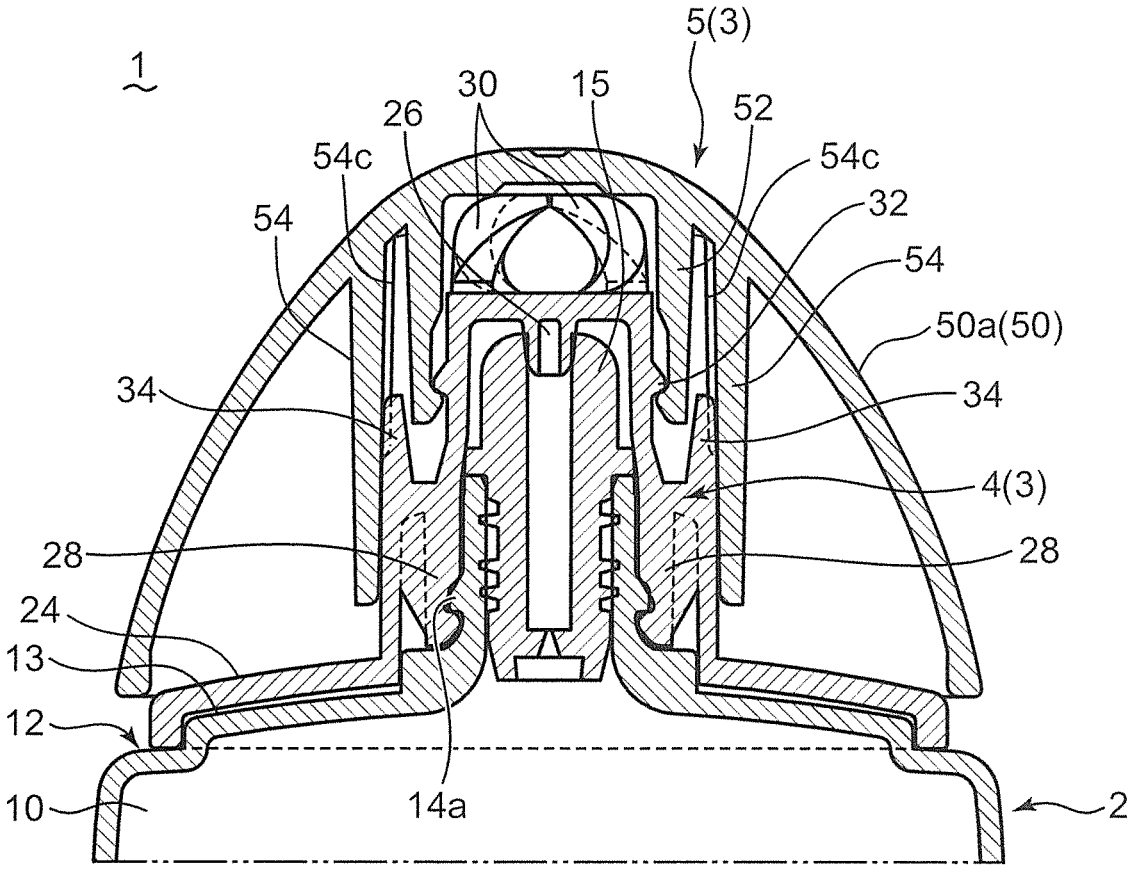
FIG. 14 is a sectional view of the main part of the eye drop container according to still another modification.

(2) The positioning portion is not essential in the present invention. Even in a case where the positioning portion is provided, the rail portions 34 and the guide ribs 54*c* may be omitted, for example, as shown in FIG. 13. Additionally, the hook portion 54*a* (the recess 54*b*) and the locking protrusion 36 may be omitted as shown in FIG. 14. In short, while the eye drop container 1 of the above embodiment adopts the above-described two configurations as a configuration for positioning the cover cap 5 in the rotational direction with respect to the cap body 4, the cover cap 5 may be positioned in the rotational direction only by any one of the configurations as shown in FIG. 13 or FIG. 14.

In a case of the configuration shown in FIG. 13, while arranging the cover cap 5 at the temporary engagement position P0 produces an effect of positioning the cover cap 5 in the rotational direction, as well as stably positioning the cap body 4 both inwardly and outwardly by the outer locking pieces 54, the cover cap body 50 is likely to fluctuate with the hood portion 20 of the cap body 4 as a supporting point because of lack of the rail portions 34, and for example, even when only a rotational force is applied to the cover cap 5, the cover cap 5 partially fits the base portion 24, so that the cap body 4 might rotate unintentionally. On the other hand, in a case of the configuration shown in FIG. 14, while the fluctuation and the like can be prevented due to provision of the rail portions 34 and the like, because the rail portions 34 and the guide ribs 54*c* are located inward from both ends of the cover cap 5, even when a relatively small rotational force is applied to the both ends of the cover cap 5, the rail portions 34 easily go over the guide ribs 54*c*, so that the cover cap 5 might unintentionally rotate. Accordingly, it is suitable to adopt such a configuration as of the above embodiment in terms of realizing both positioning of the cover cap 5 and improvement in functionality of the child resistance function.

(3) While in the above embodiment, the eye drop container 1 has been described as one example of a "container" of the present invention, the present invention is also applicable to, for example, a container for containing an eye drop, an oral medicine, a nose drop, a contact-lens cleaning solution or the like other than an eye drop container. The present invention is also applicable to a container for containing a powdered medicine and a tablet other than a liquid medicine. In such a case, it can be configured to close an opening of the tubular neck portion 14 by the cap body 4 without providing the nozzle 15. In this case, the stopper portion 26 meeting the opening may be provided on the ceiling surface 22*b* of the cap body 4 to close the opening by the stopper portion 26, or the opening may be directly closed by the ceiling surface 22*b* (or a sealing member provided on the ceiling surface 22*b*, or the like) without providing the stopper portion 26.

(4) While in the above embodiment, the shape of the "container" is flat as shown in FIGS. 7A and 7B because the present invention is applied to an eye drop container, a specific shape of a "container" is appropriately selected according to a substance to be contained and is not limited to the shape of the embodiment. The "container" may have, for example, a cylindrical shape.

The present invention described above is summarized as follows.

The container according to the present invention includes a container body having an opening portion; and a cap which closes the opening portion and locks onto the container body, the container body and the cap being locked by putting the cap on the container body and pressing the cap toward a direction of the container body, in which the cap includes a cap body having a cap locking portion which locks the cap onto the container body, a cover cap which covers the cap body and is held on the cap body so as to be displaceable and rotatable in an up-down direction with respect to the cap body, and an urging portion which upwardly urges the cover cap, and when a rotational force is applied to the cover cap being downwardly pressed against an urging force of the urging portion, the cap body is displaced in conjunction with the cover cap, so that locking between the cap body and the container body is released, and in a state where the cover cap is not downwardly pressed, the cap body is not displaced in conjunction with rotation of the cover cap even when a rotational force is applied to the cover cap, so that locking between the cap body and the container body is not released.

Accordingly, such a configuration realizes a child resistance function in a twist cap-type container without greatly impairing easiness of attaching/detaching a cap.

In the above container, for transmitting a rotational force of the cover cap to the cover cap to cause the cover cap to work in conjunction in a state where the cover cap is downwardly pressed against an urging force of the urging portion, a configuration can be adopted in which application of a rotational force to the cover cap causes the cover cap to contact the cap body and to press the cap body, and the configuration is not particularly limited to a specific configuration. It is possible to adopt, for example, a configuration in which the cover cap has a pressing portion, and the cap body has a pressed portion contacted by the pressing portion and pressed, the pressed portion being located on a moving track of the movement of the pressing portion as a result of application of a rotational force to the cover cap.

Specifically, in the above container, it is preferable that the pressing portion is an inner surface of the cover cap and the pressed portion is an outer surface of the cap body. In other words, it is preferable that the inner surface of the cover cap and the outer surface of the cap body contact with each other, the outer surface of the cap body being positioned on a moving track of the movement of the inner surface as a result of application of a rotational force to the cover cap and being opposed to the inner surface of the cover cap, so that the inner surface of the cover cap presses the outer surface of the cap body. The inner surface of the cover cap is, for example, an inner surface of a wall portion in the cover cap having a housing space (a space which houses an upper part of the cap body) surrounded by a wall portion configured with an inner surface and an outer surface. The outer surface of the cap body opposed to the inner surface of the cover cap is, for example, an outer surface of the wall portion in the cap body having a housing space (a space which houses an upper part of the container body) surrounded by a wall portion configured with an inner surface and an outer surface.

In order to more effectively realize the child resistance function without greatly impairing easiness of attaching/detaching a cap, it is suitable that, in the above container, the cover cap has an inner surface which is opposed to an outer surface of the cap body in a state where the cover cap is pressed downwardly against an urging force of the urging portion, the inner surface contacting and pressing the outer surface following the rotation to cause the cap body to work in conjunction with the cover cap. In particular, it is preferable that the inner surface of the cover cap is designed to be an inner surface of a side wall of the cover cap and the outer surface of the cap body is designed to be an outer surface of a circumferential wall portion of a base portion. Above all, it is suitably configured such that a lower end portion of the inner surface of the side wall of the cover cap is brought into contact with a lower end portion of the outer surface of the circumferential wall portion in the base portion of the cap body to press the same.

Additionally, more preferably, the above container is preferably configured such that the cover cap has a first pressing portion and a second pressing portion, the cap body has a first pressed portion contacted by the first pressing portion and pressed, and a second pressed portion contacted by the second pressing portion and pressed, and the first pressed portion and the second pressed portion are located on a moving track of the movement of the first pressing portion and the second pressing portion as a result of application of a rotational force to the cover cap.

Specifically, in the above container, the cover cap includes a side wall having a pair of inner surfaces opposed to each other via the cap body, one inner surface of the opposed inner surfaces being the first pressing portion and the other inner surface of the opposed inner surfaces being the second pressing portion, and the cap body includes a base portion having a pair of outer surfaces opposed to the first pressing portion and the second pressing portion of the cover cap, one outer surface of the opposed outer surfaces being the first pressed portion and the other outer surface of the opposed outer surfaces being the second pressed portion.

In order to more effectively realize the child resistance function in the above container without greatly impairing easiness of attaching/detaching a cap, the cap body suitably has a base portion to which the cover cap externally fits, the external fitting causing the cap body to work in conjunction with the rotation of the cover cap.

The container of the present invention may be a container in which the cap is put on the container body and pressed toward a direction of the container body to lock the cap and the container body, and is not particularly limited to a specific configuration. For example, a configuration can be adopted in which a locking portion that locks on a cap locking portion of the cap body is provided in the container body. Specifically, it is suitable to provide a locking protrusion as the locking portion of the container body and a locking piece as the cap locking portion of the cap body. It is suitably configured such that after the cap is put on the container body and pressed toward the direction of the container body to cause the locking piece to contact the locking protrusion, the locking piece goes over the locking protrusion due to elastic deformation thereof, and after the locking piece goes over the locking protrusion, the locking piece is elastically restored to lock the cap and the container body.

In order to cause the cap body to be displaced in conjunction with the cover cap in the above container, it is preferably configured such that contacting between the cap body that works in conjunction with the cover cap and the container body causes displacement of the cap body, but the configuration is not particularly limited to a specific configuration. The container body preferably has a guide portion which contacts the cap body that works in conjunction with the cover cap to displace the cap body.

In the above container, the guide portion preferably has a part located on a moving track of the cap body to start the contacting, and an upper part formed continuously with the part and located upward of the part in an up-down direction. Above all, the guide portion suitably has a part with a position in the up-down direction (height) gradually increased along a moving track of the cap body. In order to more effectively realize the child resistance function without greatly impairing easiness of attaching/detaching a cap, the container body has a guide portion which, when a rotational force is applied to the cover cap being pressed downwardly against an urging force of the urging portion, contacts the cap body that works in conjunction with the cover cap, to displace the cap body, and the cap body gets on the guide portion to be displaced, thereby releasing locking between the cap body and the container body.

In the above container, the guide portion of the container body preferably has a first guide portion and a second guide portion. Specifically, a container suitably includes the cap cover including a side wall having a pair of inner surfaces opposed to each other via the cap body, the cap body including a base portion having a pair of wall portions opposed to the pair of inner surfaces of the cap cover, a first guide portion to which one wall portion of the pair of wall portions in the base portion contacts and gets on, and a second guide portion to which the other wall portion of the pair of wall portions contacts and gets on.

In order to more effectively realize the child resistance function in the above container without greatly impairing easiness of attaching/detaching a cap, it is suitable that the container body has a regulating portion which contacts the cap body, and in a state where the cover cap is pressed downwardly against an urging force of the urging portion, when a rotational force is applied to the cap body, application of a rotational force to the cover cap in a first rotational direction displaces the cap body in conjunction with the cover cap, thereby releasing locking between the cap body and the container body, and application of a rotational force in a direction opposite to the first rotational direction causes the cap body to contact the regulating portion and refrain from being displaced, thereby not releasing locking between the cap body and the container body.

In the above container, the regulating portion can have any configuration to contact the cap body to prevent displacement of the cap body when a rotational force is applied in a direction opposite to the first rotational direction, but is not limited to a specific configuration. For example, the container body preferably has the regulating portion opposed to a circumferential wall portion of a base portion of the cap body inwardly and outwardly. Above all, it is suitable to provide a regulation surface in a protrusion portion in a shoulder portion of the container body, the regulation surface contacting the circumferential wall portion of the base portion to prevent the cap body from rotating, in which the regulation surface is used as the regulating portion to prevent the base portion from getting on the container body.

In order to prevent the cover cap from unintentionally rotating, and thus avoiding impaired handleability and designability of a container, it is preferable that, in the above container, the cap body and the cover cap have positioning portions, one of which contacts the other in the rotational direction to position the cover cap in a rotational direction of the cover cap, and after one of the cap body and the cover cap contacts the other as the cover cap rotates with respect to the cap body, elastic deformation of at least one of the cap body and the cover cap releases the positioning.

In the above container, the positioning portion may have any configuration in which after one of the cap body and the cover cap contacts the other to produce a positioning effect as the cover cap rotates with respect to the cap body, the positioning portion is released from positioning by elastic deformation of at least one of the cap body and the cover cap as the cover cap further rotates, thereby allowing the cover cap to rotate, but the positioning portion is not particularly limited to a specific configuration. In a state where the cover cap is not downwardly pressed against an urging force of the urging portion, the positioning portion is preferably configured to have positioning released by elastic deformation of a least one of the cap body and the cover cap after one of the two contacts the other as the cover cap rotates with respect to the cap body.

The above container is preferably configured to include the cap body having the protrusion portion, and the cover cap having a protrusion portion opposed to the protrusion portion in a rotational direction, in which after the protrusion portion provided in the cover cap contacts the cap body, at least one of the cap body and the cover cap is elastically displaced. Above all, it is suitable that with the protrusion portion provided in the cap body as a rail portion and the protrusion portion provided in the cover cap as a guide rib, after the rail portion contacts the guide rib, at least one of the rail portion and the guide rib is elastically deformed. The above-described positioning portion may be referred to as a first positioning portion and a positioning portion to be described later may be referred to as a second positioning portion in some cases. In order to prevent the cover cap from unintentionally rotating, and thus avoiding impaired handleability and designability of a container, the above container suitably includes positioning portions, one of which contacts the other in the rotational direction to position the cover cap in the rotational direction of the cover cap in a state where the cover cap is not pressed downwardly against an urging force of the urging portion, and after one of the cap body and the cover cap contacts the other as the cover cap rotates with respect to the cap body, the cover cap gets on the cap body to release the positioning.

In the above container, the positioning portion may have any configuration in which after one of the cap body and the cover cap contacts the other to produce a positioning effect as the cover cap rotates with respect to the cap body in a state where the cover cap is not pressed downwardly against an urging force of the urging portion, the cover cap gets on the cap body to release positioning, thereby allowing the cover cap to rotate, but the configuration is not particularly limited to a specific configuration. For example, it is suitably configured such that the cap cover has an inner surface opposed to an outer surface of the cap body inwardly and outwardly, and after the outer surface contacts the inner surface following the rotation, the cover cap is upwardly displaced with respect to the cap body, so that a lower end portion of the cover cap gets on the cap body to release positioning and allow the cover cap to rotate. Such a positioning portion may be referred to as the second positioning portion in some cases. The outer surface of the cap body is, for example, the outer surface of the wall portion in the cap body having the housing space (the space which houses the upper part of the container body) surrounded by the wall portion configured with the inner surface and the outer surface as described above. The inner surface of the cover cap inwardly and outwardly opposed to the outer surface of the cap body is, for example, the inner surface of the wall portion in the cover cap having the housing space (the space which houses an upper part of the cap body) surrounded by the wall portion configured with the inner surface and the outer surface as described above.

In view of improvement in productivity and reduction in production costs of a container, in the above container, it is suitable that the cover cap has a ceiling surface in an inside upper portion thereof, the cap body has an upper end surface opposed to the ceiling surface, and the urging portion is an elastic bending piece formed integrally with the upper end surface or the ceiling surface to be interposed between the upper end surface and the ceiling surface in a state of being compressed in the up-down direction. For example, an urging member such as a metal coil spring or the like may be provided as the urging portion.

In view of usefulness as a container for containing an eye drop, a nose drop, or the like, it is suitable that, in the above container, the container body has a tubular neck portion and a nozzle port, and the cap body includes a stopper portion which is inserted into the nozzle port to close the nozzle port.

In the above container, because the container body can be lightly squeezed to extract a small dose of medical solution, the container body and the cap are suitably flat and generally rectangular or oval in section.

In order to maintain a holding position of the cap cover with respect to the cap body as soon as possible, the above container preferably includes the cap body having protrusion pieces extending in the up-down direction, and the cover cap having protrusion pieces located outwardly opposed to the protrusion pieces of the cap body and extending in the up-down direction. Above all, it is suitable to design the protrusion pieces provided in the cap body to extend in the up-down direction as protrusion pieces of a rail portion and the protrusion pieces provided in the cover cap to extend in the up-down direction as locking pieces suspending from a lower surface of a ceiling wall.

The invention claimed is:

1. A container comprising:

a container body having an opening portion; and a cap that closes the opening portion and locks onto the container body, the container body and the cap being locked by putting the cap on the container body and pressing the cap toward a direction of the container body, wherein the cap includes a cap body having a cap locking portion that locks the cap onto the container body, a cover cap that covers the cap body and is held on the cap body so as to be displaceable and rotatable in an up-down direction with respect to the cap body, and an urging portion that upwardly urges the cover cap, the cap body and the cover cap have respective positioning portions for positioning the cover cap at a predetermined position in a rotational direction of the cover cap with respect to the cap body, the positioning portions are configured to release the positioning of the cover cap and allow the cover cap to rotate when a rotational force is applied to the cover cap not being pressed down, the cover cap includes an inner surface to be opposed to an outer surface of the cap body only when the cover cap is pressed down against an urging force of the urging portion from the predetermined position, when the cover cap is pressed down against the urging force of the urging portion and a rotational force is applied to the cover cap from the predetermined position, the inner surface of the cover cap comes into contact with the outer surface and rotates the cap body in conjunction with the cover cap to thereby release locking between the cap body and the container body, and in a state where the cover cap is not downwardly pressed against the urging force of the urging portion, the cap body is not displaced in conjunction with rotation of the cover cap so that locking between the cap body and the container body is not released when a rotational force is applied to the cover cap, and in the state where the cover cap is not pressed down against the urging force of the urging portion, the cover cap rotates in non-conjunction with the cap body in a first rotational direction or a direction opposite to the first rotational direction.

2. The container according to claim 1, wherein the cap body has a base portion to which the cover cap externally fits, the external fitting causing the cap body to work in conjunction with the rotation of the cover cap.

3. The container according to claim 1, wherein the container body has a guide portion which, when a rotational force is applied to the cover cap being pressed downwardly against an urging force of the urging portion, contacts the cap body that works in conjunction with the cover cap, to displace the cap body, and the cap body goes on the guide portion to be displaced, so that locking between the cap body and the container body is released.

4. The container according to claim 1, wherein the container body has a regulating portion that contacts the cap body, and in a state where the cover cap is pressed downwardly against an urging force of the urging portion, when a rotational force is applied to the cap body, application of a rotational force to the cover cap in the first rotational direction displaces the cap body in conjunction with the cover cap, so that locking between the cap body and the container body is released, and application of a rotational force to the cap body in the direction opposite to the first rotational direction causes the cap body to contact the regulating portion and refrain from being displaced, so that locking between the cap body and the container body is not released.

5. The container according to claim 1, wherein the rotation of the cover cap with respect to the cap body causes one of the positioning portions to come into contact with another of the positioning portions and releases the positioning due to elastic deformation of at least one of the positioning portions.

6. The container according to claim 1, wherein the container body and the cap our flat and generally rectangular or oval in section, the cap body has a hood that is cylindrical and closes the opening portion of the container body, and a base that extends outwardly from one end of the hood on the container body side along the container body, and the rotation of the cover cap with respect to the cap body causes one of the positioning portions to come into contact with another of the positioning portions so that the cover cap goes on the base portion of the cap body to release the positioning.

7. The container according to claim 1, wherein the cover cap has a ceiling surface in an inside upper portion of the cover cap, the cap body has an upper end surface opposed to the ceiling surface, and the urging portion is an elastic bending piece formed integrally with the upper end surface or the ceiling surface to be interposed between the upper end surface and the ceiling surface in a state of being compressed in the up-down direction.

8. The container according to claim 1, wherein the container body has a tubular neck portion and a nozzle port, and the cap body includes a stopper portion which is inserted into the nozzle port to close the nozzle port.

9. The container according to claim 1, wherein the container body and the cap are flat and generally rectangular or oval in section, and the positioning portions hold the cover cap and the cap at the predetermined position where an outer circumferential surface of the cover cap and an outer circumferential surface of the container body are substantially continuous with each other.

* * * * *